United States Patent [19]

Güntert et al.

[11] Patent Number: 4,737,085

[45] Date of Patent: Apr. 12, 1988

[54] FUEL INJECTION PUMP FOR INTERNAL COMBUSTION ENGINES

[75] Inventors: Josef Güntert, Gerlingen; Walter Häfele, Fellbach; Eberhard Hofmann, Kirchberg, all of Fed. Rep. of Germany

[73] Assignee: Robert Bosch GmbH, Stuttgart, Fed. Rep. of Germany

[21] Appl. No.: 90,475

[22] Filed: Aug. 28, 1987

Related U.S. Application Data

[62] Division of Ser. No. 854,250, Apr. 21, 1986.

[30] Foreign Application Priority Data

Jun. 22, 1985 [DE] Fed. Rep. of Germany ..... 3522451

[51] Int. Cl.[4] ..... F04B 7/04; F04B 39/10

[52] U.S. Cl. ..... 417/490; 417/499; 123/501; 123/509

[58] Field of Search ..... 417/490, 494, 499; 123/500, 501, 503, 509

[56] References Cited

U.S. PATENT DOCUMENTS

| | | | |
|---|---|---|---|
| 2,729,168 | 1/1956 | Ziesche | 417/499 |
| 2,731,917 | 1/1956 | Evans | 417/494 |
| 3,667,437 | 6/1972 | Dreisin | 123/139 R |
| 3,712,763 | 1/1973 | Parks | 417/499 |
| 3,972,655 | 8/1976 | Tsunematsu | 417/494 |
| 4,073,275 | 2/1978 | Hoter | 417/494 |
| 4,413,600 | 11/1983 | Yanagawa | 417/494 |

FOREIGN PATENT DOCUMENTS

| | | | |
|---|---|---|---|
| 165459 | 3/1950 | Australia | 417/494 |
| 1395384 | 5/1975 | United Kingdom | 123/503 |

*Primary Examiner*—Carlton R. Croyle
*Assistant Examiner*—Jane E. Obee
*Attorney, Agent, or Firm*—Greigg Edwin E.

[57] ABSTRACT

A fuel injection pump for internal combustion engines having control slides that are both axially displaceable and rotatable on the pump piston via a governor rod for controlling the injection quantity and the injection onset. A slit hub is releasably clamped on the governor rod with a driver arm, the hub being arranged to engage the control slide between two working faces and the hub has a driver recess for the rotational adjustment of the control slide. The driver recess is engaged by a tang joined with the control slide.

4 Claims, 4 Drawing Sheets

Fig.2
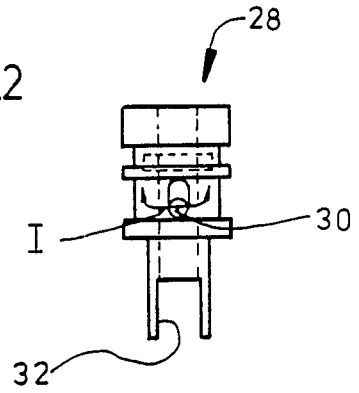
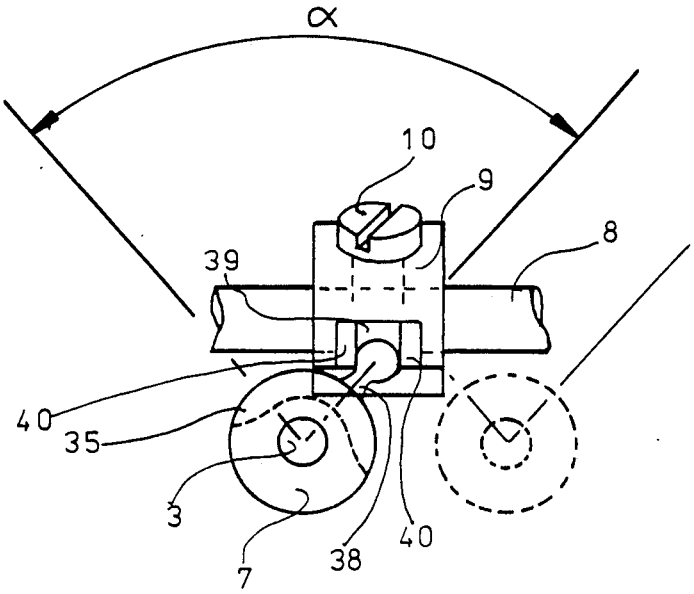
Fig. 3

FUEL INJECTION PUMP FOR INTERNAL COMBUSTION ENGINES

This application is a division of application Ser. No. 854,250 filed Apr. 21, 1986.

BACKGROUND OF THE INVENTION

The invention is based on a fuel injection pump as generally defined hereinafter. Fuel injection pumps of this type operate at extraordinarily high pressures, and manufacturers of the internal combustion engines for whom such pumps are intended make stringent demands as to the quality of the injection they attain. This applies particularly to controlling both the supply quantity and the supply onset. The quality of this control depends substantially on the operating capacity of the control slide and on the relief bore that cooperates with it. The control itself can be effected via an oblique groove disposed in the pump piston and arranged to cooperate with a diversion opening in the control slide, or by means of a control bore in the pump piston that cooperates with a recess, having at least one oblique control edge, in the control slide. The operating capacity of the control thus depends on both the size of the angle of rotation and the length of the control stroke of the control slide, which is determined primarily by the manner of coupling provided between the control slide and the governor rod. This coupling should furthermore be low in friction and provide favorable lever ratios, and it should avoid premature wear caused by unilaterally overloaded locations.

In a known fuel injection pump of this type (German Offenlegungsschrift No. 21 41 206), a radially oriented tang is disposed on the control slide, with a ball head on its free end arranged to engage a corresponding recess in the governor rod. This known fuel injection pump has the disadvantage that the stroke adjustment and rotational angle that can be achieved are both relatively small, so that this type of coupling attains only a limited operating capacity. A further advantage is that the individual couplings and thus the individual control slides are not adjustable relative to one another, so that adjusting a single cylinder cannot be attained except via the pump piston itself. A further disadvantage of this known coupling is that by using a ball head to transmit the adjusting motion, an overstress load is exerted; this generates high cyclic pressures and causes correspondingly rapid wear.

OBJECT AND SUMMARY OF THE INVENTION

The fuel injection pump according to the invention has the distinct advantage over the prior art that first, in each pump element the position of the hub on the governor rod is variable independently for the stroke position and the rotational position of the control slide, by either rotating or axially displacing the hub on the governor rod. Second, this change in the hub position can be made in the individual pump elements independently of one another, so that the control of the individual pump elements can be adjusted independently of each other. It is admittedly known to provide a coupling operating with a clamping seat on the governor rod (German Offenlegungsschrift No. 21 46 578), but this serves only to adjust the stroke of the control slide and grips only partway around the governor rod; thus because of the reduced frictional adhesion there is the danger of misalignment caused by the shaking motion transmitted to the governor rod. Although this known coupling has a driver arm, the free end of which is guided between two operating surfaces of the control slide extending transversely to the pump piston axis to effect the axial actuation of the control slide, there is the difference that because of the additional rotational adjustability of the control slide the prior art provides for a much more problematic way, in engineering terms, of attaining combined axial and rotational adjustability.

According to another advantageous embodiment of the invention, a coupling member is joined to the control slide in a rotationally positive manner and upon an axial movement of the governor rod the coupling member is carried along with a rotary movement of the control slide. A tang disposed on the control slide serves as the coupling member and is adapted to engage a driver recess in the hug. Depending on the length of the tang and the embodiment of the driver recess, a rotational angle of approximately 90° can be attained for the control slide, which represents a high capacity for work. For example, if the injection quantity is controlled by rotating the control slide, then this provision of the invention means that a very accurate metering of the fuel quantity is performed, adapted to engine characteristics. The driver arm which in this case serves as an injection adjuster enables a sufficient stroke adjustment of the control slide, without impairing the large rotary adjustment that is possible.

According to a further advantageous embodiment of the invention, the control slide and tang comprise two parts, preferably releasably joined to one another. This has advantages especially in terms of construction and manufacturing engineering. Depending on the type of coupling, a different manner of materials treatment is needed, such as hardening and grinding of the two parts, and a structural design may be desired which is only attainable with a two-part construction. For instance according to an advantageous embodiment of the invention the driver recess is formed by a fork, and the tang engages the space between its tines; the tang is disposed parallel to the pump piston, and the recess for receiving the tang is provided on the driver arm. Here, the active surfaces of the control slide advantageously serve as an axial limitation of the tang, so that via the driver arm and the tang, both the rotational and the axial adjustment of the control slide is effected by means of the governor rod. An additional advantage of the releasable connection between the control slide and the tang is that when repairs are necessary or if there is unilateral wear of the coupling, these parts can be removed and replaced without disassembling the pump element and control slide.

According to other advantageous embodiments of the invention, the tang is disposed radially with respect to the axis of the control slide, and the tang also extends at a tangent to the hub. The tines of the fork engaged by this tang are disposed on the hub offset by 90° with respect to the driver arm. In this way, the couplings for transmitting rotary motion and for transmitting axial motion are separate from one another in terms of the lever means involved.

The invention will be better understood and further objects and advantages thereof will become more apparent from the ensuing detailed description of preferred embodiments taken in conjunction with the drawings.

BRIEF DESCRIPTION OF THE DRAWINGS

FIG. 2 is a side elevational view in the direction of the line II of the pump piston adjusting sleeve of FIG. 1;

FIG. 3, on an enlarged scale, is a view from above in the direction of the line III of FIG. 1 of the coupling between the governor rod and the control slide;

DESCRIPTION OF THE PREFERRED EMBODIMENTS

Figure 1:
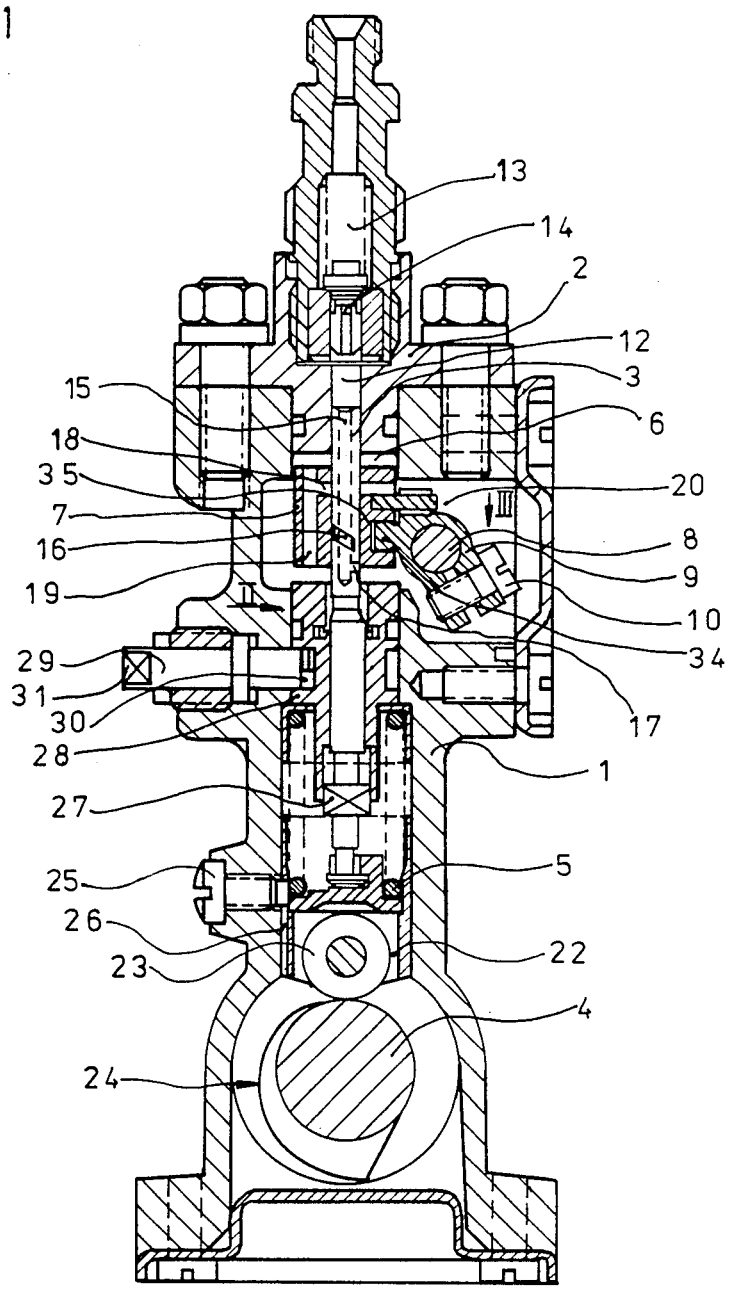
FIG. 1 is a vertical cross sectional view taken through an in-line injection pump.

The examples will be explained in terms of an in-line injection pump, of which FIG. 1 shows only one pump element; in practice, further pump elements adjoin this one in a line, the total number of pump elements corresponding to the number of cylinders in the engine. In principle, the design of the fuel injection pump is the same for both exemplary embodiments. However, the invention can also be realized in a fuel injection pump that operates with only a single pump element, an example being a plug-in pump, the pump piston of which is driven directly by the engine camshaft.

The fuel injection pump shown in FIG. 1 has a housing 1, into which a plurality of cylinder sleeves 2, only one of which is shown, has been introduced. In these sleeves 2, pump pistons 3 are driven via a camshaft 4, counter to the force of a spring 5, for their axial movement that embodies the working stroke. A free space 6 is available under the cylinder sleeve 2, receiving a control slide 7 that is axially displaceable on the pump piston 3. The individual control slides 7 that are disposed on the pump pistons 3 disposed in an in-line pump are actuated in common by a governor rod 8; to this end, a slit hub 9 is especially provided on the governor rod for coupling with each control slide 7. The control rod 8 is simultanously both rotatable and axially displaceable, and the hub 9 is clamped firmly on the governor rod 8 via a tightening screw 10.

A pump work chamber 12 is defined by the cylinder sleeve 2 and the upper end face of the pump piston 3. From the pump work chamber 12, a pressure conduit 13, in which a pressure valve 14 is disposed, leads to a pressure line, not shown, which terminates at an injection nozzle—again not shown—of the engine.

Extending within the pump piston is a blind bore 15 that ends in the pump work chamber 12 and communicates with an oblique groove 16 disposed in the jacket face of the pump piston 3; a radial bore 17 branches off from the blind bore 15 in the vicinity of its lower end. In order to equalize the pressures, two such oblique grooves and two such radial bores are typically provided, only one of each of which is shown here for the sake of simplicity.

A transverse bore 18 is provided in the control slide 7, being interrupted by the pump piston 3. One free end of the transverse bore 18 discharges on the jacket face of the control slide 7, and the other end discharges into a longitudinal bore 19, which is open toward the face ends of the control slide 7.

The control slide 7 is surrounded by a suction chamber 20 provided in the housing 1 and adapted to accommodate the free space 6. The suction chamber 20 is filled with fuel at low pressure, being supplied with fuel from the fuel tank via a feed pump, not shown. The suction chamber 20 communicates constantly with the bores 18, 19 and also with the radial bore 17 and oblique bore 16, unless the latter two bores are covered by the control slide 7.

The camshaft 4 acts via a roller tappet 22 upon the pump piston 3, making the pump piston 3 separately rotatable, while for the tangential course of the roller 23 on the cam race 24 in the housing 1, the roller tappet 22 is secured against rotation by a screw 25, which slides in a longitudinal groove 26 of the roller tappet 22. The pump piston 3 itself is guided in a rotationally positive manner via a flattened portion 27 provided on the pump piston 3 with the flattened portion 27 being guided in a correspondingly formed torsion bushing 28, which is rotatably supported in the housing 1 and is rotatable via an eccentric pin 29 that is accessible from outside the housing 1.

FIG. 2 shows the torsion bushing 28 from outside; an arrow I indicates the direction of rotation of a tang 30 of the eccentric pin 29 and thus indicates the effect of rotation when the eccentric pin 29 is rotated from outside the housing 1. This adjustment can be made automatic by using an appropriate tool to engage a square end 31 of the eccentric pin 29. For engagement by the flattened area 27 of the pump piston 3, the torsion bushing 28 has tabs 32, which being embodied like a fork cooperate in a rotationally fixed manner with the flattened portion 27 but do not hinder the axial movement of the pump piston 3.

The fuel injection pump shown in FIGS. 1 and 2 functions as follows:

As long as the pump piston assumes the bottom dead center position shown in the drawing, fuel flows out of the suction chamber 20 into the pump work chamber 12, via the radial bore 17 and the blind bore 15. This inflow of fuel into the pump work chamber 12 takes place even when the pump piston 3 is executing an intake stroke and if at that time the radial bore 17 and the oblique groove 16 are not simultaneously blocking the inflow of fuel from the suction chamber 20. Then, as soon as the rising cam race 24 drives the pump piston 3 for its compression stroke fuel flows out of the pump work chamber 12 and back to the suction chamber 20, via the blind bore 15 and the radial bore 17, until such time as the radial bore 17 moves into the control slide 7. Only after this can the high pressure required for injection build up in the pump work chamber 12. The injection taking place upon the ensuing compression stroke is interrupted whenever the oblique groove 16 is opened up by the transverse bore 18, so that once again fuel flows out of the pump work chamber 12 into the suction chamber 20.

Depending on the stroke position of the control slide 7, the stroke required for attaining the supply onset or injection onset, that is, the stroke executed until the radial bore 17 has moved into the control slide 7, varies. The higher the control slide 7 is displaced, the later is the injection onset; the farther downward the control slide 7 is displaced, the earlier is this supply onset on the part of the corresponding pump element.

Contrarily, the supply quantity or injection quantity is varied by rotating the control slide 7, because this makes the required stroke up until the oblique groove 16 is opened by the transverse bore 18 variable, since a different portion of the oblique bore 16 corresponds with the transverses bore 18 at various times, depending on the rotational position. In one rotational position of the control slide 7, the oblique groove 16 is opened up by the transverse groove 18 after a relatively short pump piston stroke; in another, this happens after a relatively long pump piston stroke. By rotating the pump piston 3 by means of the eccentric pin 29, an additional adjustment is effected by the rotational positioning of the individual pump pistons relative to one another. However, the actual injection quantity adjustment is effected via the governor rod 8 and the hub 9, and there again an adjustment of the position of the hub on the governor rod 8 takes place, and hence an adjustment of the rotational position of the control slide 7 on the pump piston 3, by means of axially displacing the hub 9 on the governor rod 8.

Figure 4:
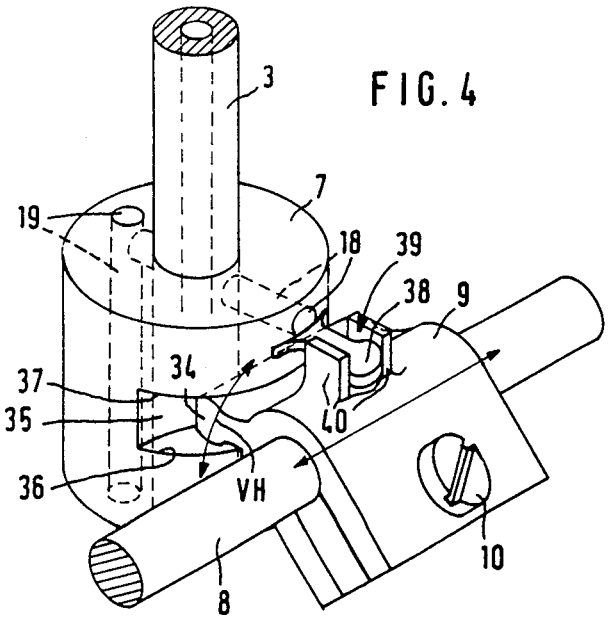
FIG. 4 is a perspective view of the coupling of the first exemplary embodiment.

The first exemplary embodiment will be understood from FIGS. 1, 3 and 4. A driver arm 34, embodied as a tang, is provided on the hub 9, pointing radially in the direction of the pump piston 3 and engaging a transverse groove 35 of the control slide 7. This driver arm 34 is embodied as a roller, with its longitudinal axis parallel to the governor rod 8, so that a linear contact of this arm roller 34 takes place with the working faces 36 and 37 of the transverse groove 35. As the governor rod 8 turns, the control slide 7 is thus displaced via linear contact, and the roller-like length of the driver arm 34 means that a linear contact remains operative in the force transmission effected during the axial displacement of the governor rod 8 as well.

As the coupling for transmitting the rotary movement of the control slide 7, a radial tang 38 that is connected to the control slide 7 in a rotationally positive manner is used; this tang 38 engages a driver recess 29 that is defined by two extensions 40 disposed on the hub 9. The free end of the radial tang 38 is ball-like, so as to enable the pivoting movement of the radial tang 38 that takes place upon the rotational movement of the control slide 7. As shown particularly in FIG. 3, during the rotational movement of the control slide 7 the head of the radial tang 38 slides along the opposed faces of the extensions 40. The radial tang 38 extends the farthest into the driver recess 39 when it is at right angles to the governor rod 8. The radial tang 38 also has a certain thickness, with cylindrical limiting surfaces, on the sides oriented toward the extensions 40, so that here again there is linear contact between the extensions 40 and the cylindrical surface of the radial tang 38. This linear contact is maintained even if the governor rod 8 and thus the hub 9 are rotated in order to adjust the level of the control slide 7, because the radial tang 38 overhangs the hub 9 at a tangent.

As shown in FIG. 3, the possible rotational angle $\alpha$ of a control slide 7 is relatively large, in fact over 80°. If the transverse groove 35 is embodied appropriately, the apparatus for adjusting the level of the control slide 7 does not hinder the rotational adjustment. For the sake of better comprehension of the apparatus, a further element is shown in broken lines beside the pump and control slide element in question.

Figure 5:
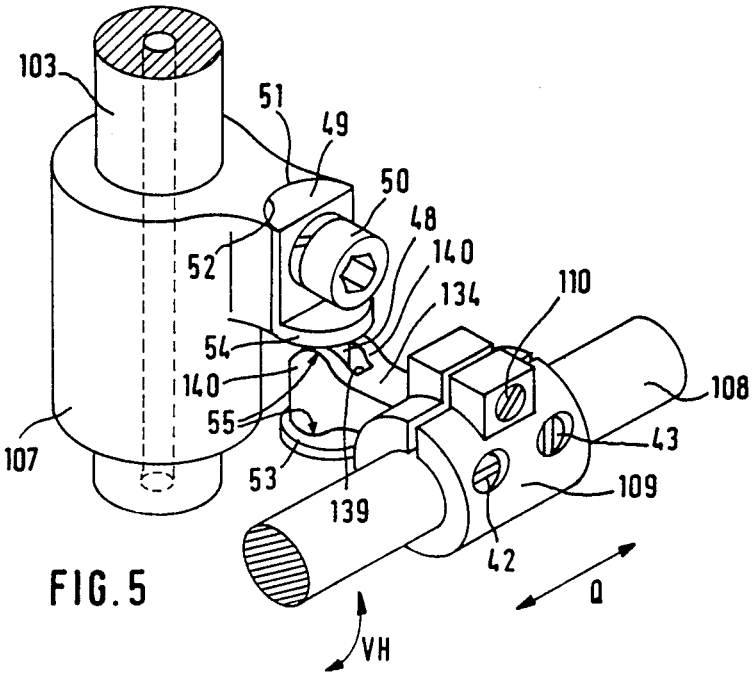
FIG. 5 is a perspective view of the coupling of the second exemplary embodiment.
Figure 6:
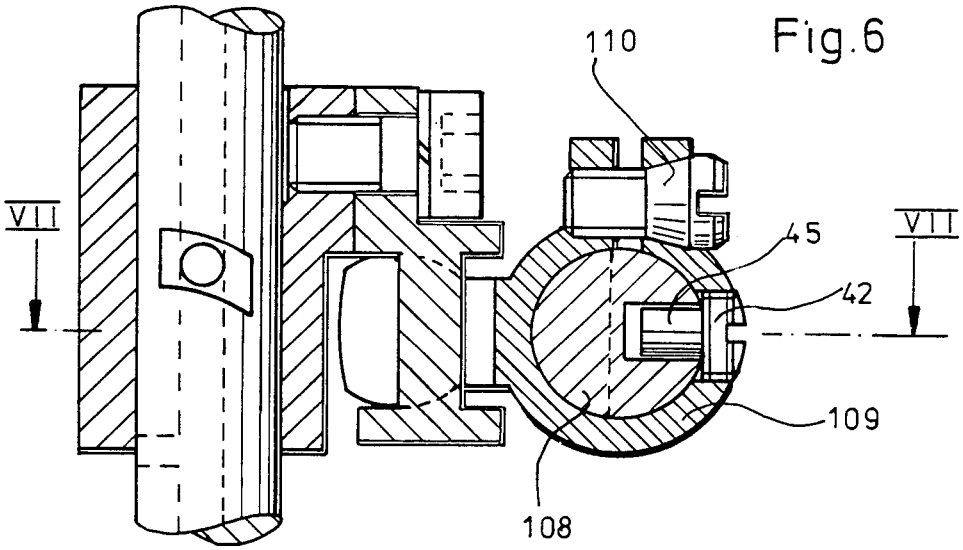
FIG. 6 is a fragmentary vertical section taken through the second exemplary embodiment in the vicinity of the coupling, along the line VI—VI in FIG. 7.
Figure 7:
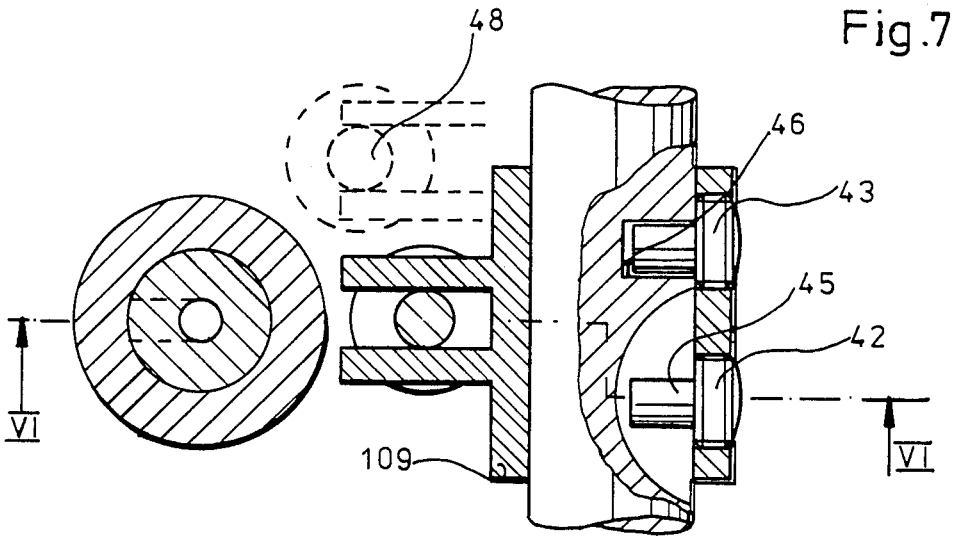
FIG. 7 is a cross section taken along the line VII—VII of FIG. 6.

The second exemplary embodiment is shown in FIGS. 5, 6 and 7, in which once again a slit hub 109 is firmly clamped to a governor rod 108 by means of a tightening screw 110; the slit hub 109 can be rotated and axially displaced on the governor rod 108 by loosening the tightening screw 110, and it can then be clamped firmly once again by re-tightening the screw 110. Here again, the hub 109 is coupled with a control slide 107, which in principle is embodied as in the first exemplary embodiment, so that the injection quantity can be varied by rotating the control slide 107 and the injection onset can be varied by axially displacing it. The pump in the second exemplary embodiment can be embodied the same as in the first, so the description of FIGS. 1 and 2 are directly applicable to it as well.

Since the adjustment of the slit hub 109 on the governor rod 108 involves only short distances, the offset provided by an eccentric screw suffices as an adjustment range for this adustment. Two eccentric screws 42 and 43 are therefore screwed into the hub 109, radially toward the governor rod 108; each of these screws, with its smooth guide shaft that is eccentrically offset relative to the head, engages a longitudinal groove 45 of the governor rod 108 for the rotational adjustment and a transverse groove 48 of the governor rod 108 for the axial adjustment. This adjustment can be made promptly by using a suitable tool: After automatic loosening of the tightening screw 110, the eccentric screws 42 and 43 are rotated until the point of adjustment, and then the tightening screw 110 is tightened once again.

Differing form the first exemplary embodiment, in this second exemplary embodiment only one coupling member is used to transmit the rotational and stroke movement. This coupling member comprises a driver arm 134 and an axial tang 48 extending parallel to the control slide 107. The axial tang 48 is disposed on a fitting element 49, which is fastened onto the control slide 107 via a hollow screw 50. On its side oriented toward the control slide 107, the fitting part 49 has a semicircular-cylindrical face 51, which rests on a corresponding face of the control slide 107. The axial tang 48, which is integral with the fitting part 49, is axially defined by flanges 53 and 54, thereby making the axial tang 48 and flanges 53, 54 into a kind of spindle. The inside of this spindle is engaged by the free end of the driver arm 134, which has a driver recess 139 for this purpose, which is defined by two extensions 140 encompassing the axial tang 48 in a forked manner. Here again, there is a linear contact respectively between the facing sides of the extensions 140 and the face of the axial tang 48 oriented toward them; as a result, the cyclic pressures and hence frictional wear are kept as low as possible. In the case of this coupling acting to transmit the rotation of the governor rod 108 the axial tang 48 is displaced parallel, during the rotary movement, to the extension faces 140 while simultaneously being rotated slightly, so that the line that is operative in the force transmission also shifts in parallel on the axial tang 48. For transmitting the stroke movement of the control slide 107, the extensions 140 are rounded off in the adjustment direction as shown at 55, and with their end faces they cooperate with the opposed faces embodied by the flanges 53 and 54.

As indicated by the broken lines in FIG. 7, here again the possible angle of rotation of the control slide 107, in this exemplary embodiment, is quite large. Because of the structural arrangement, the lever ratios are favorable and the force transmission locations are linear as the surfaces involved change.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines comprising a housing, at least one pump piston having an axis and arranged to execute a reciprocating working stroke in a pump cylinder in said housing and thereby define a pump work chamber, a blind bore in said piston extending from at least one relief bore to said pump work chamber, a control slide axially movable and rotatable on said at least one pump piston, for controlling said at least one relief bore disposed in said pump piston, whereby said at least one relief bore may be opened and closed to control fuel flow to and from said pump work chamber, a rotatable axially movable governor rod coupled with a coupling member on said control slide including a tang disposed parallel to said pump piston axis in which said tang includes axially defined spaced flanges for actuation of said control slide, said governor rod being axially displaceable for rotary movement of said control slide and disposed transversely relative to said pump piston axis, an adjustable slit hub coupling disposed between said governor rod and said control slide, said adjustable slit hub coupling including a driver arm, said driver arm including a terminal portion having a recess adapted to engage said tang between said spaced flanges on said control slide which upon axial movement of said governor rod carries said control slide along in order to effect a rotational as well as an axial movement of said control slide.

2. A fuel injection pump as defined by claim 1, in which said control slide and said tang comprise two parts, which are preferably joined to one another.

3. A fuel injection pump as defined by claim 1, in which said driver recess is bifurcated and said tang is guided therebetween.

4. A fuel injection pump as defined by claim 1, in which said spaced flanges of said tang serve as axial limitations of said driver arm, whereby via said driver arm and said tang both the rotational and the axial adjustment of said control slide are effected by means of said governer rod.

* * * * *